US009534182B1

(12) United States Patent
Ballard

(10) Patent No.: US 9,534,182 B1
(45) Date of Patent: Jan. 3, 2017

(54) METHOD OF PRODUCING INDUSTRIAL CORN BASE OIL FROM A FERMENTATION BYPRODUCT OF A CORN ETHANOL PRODUCTION PROCESS

(71) Applicant: Alan Ballard, Columbus, IN (US)

(72) Inventor: Alan Ballard, Columbus, IN (US)

(73) Assignee: LiquiTech, LLC, Farmersburg, IN (US)

( * ) Notice: Subject to any disclaimer, the term of this patent is extended or adjusted under 35 U.S.C. 154(b) by 210 days.

(21) Appl. No.: 14/132,133

(22) Filed: Dec. 18, 2013

Related U.S. Application Data

(60) Provisional application No. 61/738,597, filed on Dec. 18, 2012.

(51) Int. Cl.

| | |
|---|---|
| ***C10M 175/00*** | (2006.01) |
| ***C07F 5/04*** | (2006.01) |
| ***C10L 1/22*** | (2006.01) |
| ***C11B 1/00*** | (2006.01) |
| ***C11B 3/00*** | (2006.01) |
| ***C11B 7/00*** | (2006.01) |
| ***C11B 13/00*** | (2006.01) |
| ***C10L 1/18*** | (2006.01) |
| ***C10M 145/10*** | (2006.01) |
| ***C10M 149/12*** | (2006.01) |

(52) U.S. Cl.
CPC ..... *C10L 1/1802* (2013.01); *C10M 145/10* (2013.01); *C10M 149/12* (2013.01)

(58) Field of Classification Search
CPC .... C10M 133/04; C10M 2215/02; C11B 3/06; C11B 1/04; C11B 13/02
USPC ..... 508/200, 547, 111; 554/8, 177; 210/208
See application file for complete search history.

(56) References Cited

U.S. PATENT DOCUMENTS

| | | | |
|---|---|---|---|
| 2,236,493 | A | 3/1941 | Moore |
| 2,380,411 | A | 7/1945 | Buxton |
| 2,408,904 | A | 10/1946 | Black |
| 3,771,989 | A | 11/1973 | Pera et al. |
| 4,506,081 | A | 3/1985 | Fenyes et al. |
| 4,609,500 | A | 9/1986 | Strecker |
| 4,970,010 | A | 11/1990 | Erickson et al. |
| 5,250,182 | A | 10/1993 | Bento et al. |

(Continued)

FOREIGN PATENT DOCUMENTS

| | | | |
|---|---|---|---|
| EP | 0 368 593 | A1 | 5/1990 |
| WO | WO 2012/107230 | A1 | 8/2012 |

OTHER PUBLICATIONS

Oil-Dri Corporation of America Brochure, "Pure-Flo® Bleaching Earths," ©2011, 24 pgs.

(Continued)

*Primary Examiner* — Prem C Singh
*Assistant Examiner* — Francis C Campanell
(74) *Attorney, Agent, or Firm* — William F. Bahret

(57) ABSTRACT

A method of producing industrial corn base oil from a raw corn oil byproduct of a corn ethanol production process. The raw corn oil byproduct of the corn ethanol production process is first washed to separate water-soluble products from raw corn oil, then the free fatty acid in the resulting corn oil is neutralized using potassium hydroxide, and a polymeric quaternary biocide is added in a demulsification step, followed by vacuum dehydration of the demulsified corn oil, degumming of the dehydrated corn oil using citric acid, removal of red color from the oil, and final polishing.

1 Claim, 1 Drawing Sheet

(56) References Cited

U.S. PATENT DOCUMENTS

| | | | | |
|---|---|---|---|---|
| 5,716,917 | A | 2/1998 | Williams et al. | |
| 5,888,947 | A | 3/1999 | Lambert et al. | |
| 6,632,952 | B1 | 10/2003 | Daniels | |
| 6,924,381 | B2 | 8/2005 | Dawson | |
| 7,638,644 | B2 | 12/2009 | Lee et al. | |
| 8,287,731 | B2 | 10/2012 | Marshall et al. | |
| 2002/0198393 | A1 | 12/2002 | Daniels et al. | |
| 2006/0062753 | A1* | 3/2006 | Naraghi | A01N 33/12 424/78.27 |
| 2010/0051524 | A1 | 3/2010 | Marshall et al. | |
| 2010/0175312 | A1* | 7/2010 | Roden | C10L 1/026 44/447 |
| 2012/0238770 | A1 | 9/2012 | Bloomer et al. | |

OTHER PUBLICATIONS

Atomes Data Sheet, "Poly Quat Water Treatment Quaternary Biocides," undated, 3 pgs.

Buckman Laboratories Data Sheet, Busan® 77 Microbicide, ©2006, 2 pgs.

Moreau, R., "Corn Oil," in *Bailey's Industrial Oil and Fat Products, Sixth Edition* (ed. F. Shahidi), ©2005 John Wiley & Sons, Inc., vol. 2, Ch. 4, pp. 149-172.

Anderson, D., "A Primer on Oils Processing Technology," in *Bailey's Industrial Oil and Fat Products, Sixth Edition* (ed. F. Shahidi), ©2005 John Wiley & Sons, Inc., vol. 5, Ch. 1, pp. 1-56.

De Greyt, W. et al., "Deodorization," in *Bailey's Industrial Oil and Fat Products, Sixth Edition* (ed. F. Shahidi), ©2005 John Wiley & Sons, Inc., vol. 5, Ch. 8, pp. 341-383.

Erhan, S., "Vegetable Oils as Lubricants, Hydraulic Fluids, and Inks," in *Bailey's Industrial Oil and Fat Products, Sixth Edition* (ed. F. Shahidi), ©2005 John Wiley & Sons, Inc., vol. 6, Ch. 7, pp. 259-278.

Moreau, R., "Corn Oil," in *Vegetable Oils in Food Technology: Composition, Properties and Uses* (ed. F. Gunstone), ©2002, Blackwell Publishing Ltd., Ch. 10, pp. 278-296.

* cited by examiner

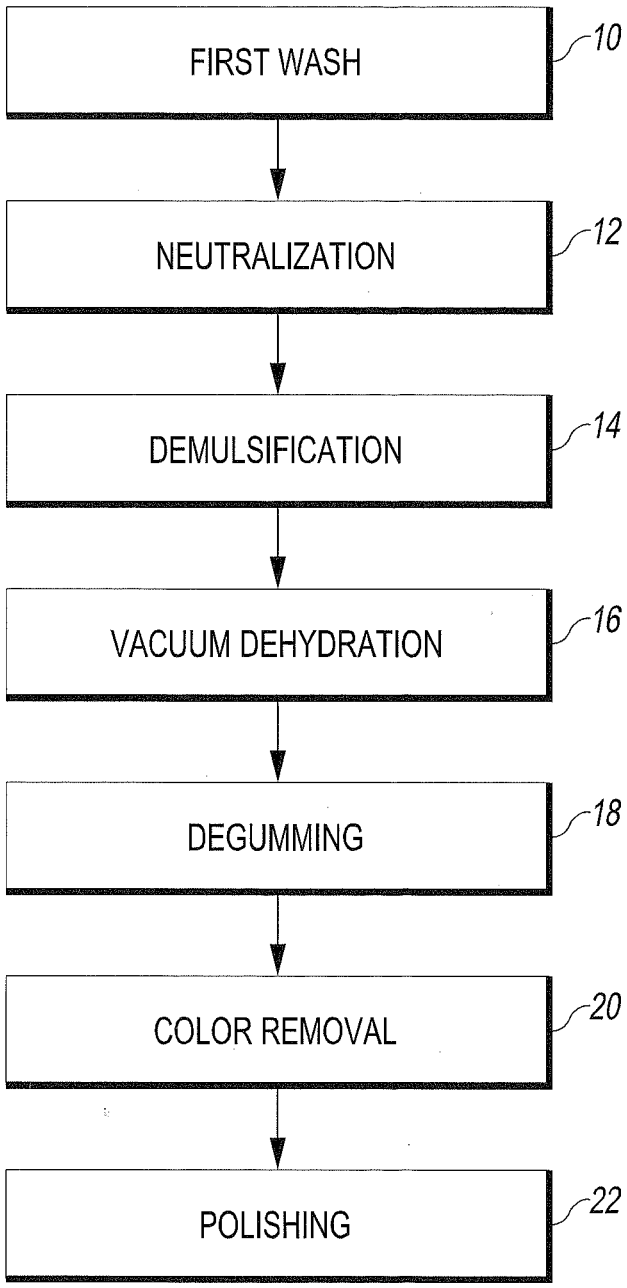
FIRST WASH
10
NEUTRALIZATION
12
DEMULSIFICATION
14
VACUUM DEHYDRATION
16
DEGUMMING
18
COLOR REMOVAL
20
POLISHING
22

METHOD OF PRODUCING INDUSTRIAL CORN BASE OIL FROM A FERMENTATION BYPRODUCT OF A CORN ETHANOL PRODUCTION PROCESS

CROSS-REFERENCE TO RELATED APPLICATION

This application claims the benefit of Provisional Patent Application No. 61/738,597, filed Dec. 18, 2012, which application is hereby incorporated by reference.

BACKGROUND OF THE INVENTION

This invention relates to corn oil processing and, more particularly, to processing of corn oil byproducts of other processes for use in making an industrial base oil for engine oil or industrial lubricants or additives.

SUMMARY OF THE INVENTION

One aspect of the present invention is a method of producing industrial corn base oil from a fermentation byproduct of a corn ethanol production process, the method comprising the following steps:

washing a fermentation byproduct of a corn ethanol production process to separate water-soluble products from raw corn oil;

neutralizing free fatty acid in the resulting corn oil;

subsequently demulsifying said corn oil, using a polymeric quaternary biocide;

dehydrating said demulsified corn oil; and degumming said dehydrated corn oil.

Another aspect of the present invention is an industrial corn base oil which comprises neutralized corn oil in combination with a polymeric quaternary biocide, with a preferred combination having at least 95% by volume neutralized corn oil and 0.05-1% by volume polymeric quaternary biocide.

The objects and advantages of the present invention will be more apparent upon reading the following detailed description in conjunction with the accompanying drawings.

BRIEF DESCRIPTION OF THE DRAWING

FIG. 1 is a flowchart for a preferred embodiment of a method of producing industrial corn base oil from a fermentation byproduct of a corn ethanol production process in accordance with the present invention.

DESCRIPTION OF PREFERRED EMBODIMENTS

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

Referring to FIG. 1, step 10, a first wash, is the first step in one preferred embodiment of a method of producing industrial corn base oil in accordance with the present invention. The starting material for this embodiment is a fermentation byproduct of a corn ethanol production process, and, more particularly, is a raw corn oil byproduct of the distillation stage which follows the fermentation stage of a conventional process for producing ethanol from corn. Corn ethanol can be produced by a dry milling process or a wet milling process, and the present invention can start with the raw corn oil byproduct of either process, including but not limited to starting materials such as whole stillage, thin or liquid stillage, and syrup derived from thin stillage.

Refining of the raw corn oil begins in step 10 with the raw corn oil byproduct from the corn ethanol manufacturing process placed into a first cone-bottom tank with a capacity of, e.g., 5000 gallons, where water at or near 100° F. is added. Other water temperatures between 80° and 120° may be suitable in certain applications. The amount of warm water added is preferably ⅓ of the oil by volume. For example, for 600 gallons of raw corn oil byproduct, 200 gallons of warm water are added. Other amounts of water in the range of 25-50% may be suitable in certain applications. The solution is then agitated in the tank, preferably for 30-60 minutes, after which the solution sets in the tank to allow separating, for 12-24 hours for example. The solution separates into layers, with water on the bottom. The bottom layer of water is decanted off the first tank through a clear hose connected to the outlet at the bottom of the tank.

Step 12 begins a second wash, starting with the preparation of a solution of potassium hydroxide (KOH) (0.05% by volume) and 100° F. water. Other water temperatures between 100° and 150° may be suitable in certain applications. The KOH is used to neutralize the free fatty acid in the raw corn oil byproduct. The solution of KOH is preferably added in the amount of about ¼ of the oil in the tank by volume. For example, for 400 gallons corn oil in the tank after the above decanting step, 100 gallons of the solution are added. The solution is then agitated in the tank, preferably for 30-60 minutes. Potassium hydroxide is preferred but sodium hydroxide may be used.

The next step, step 14, introduces a polymeric quaternary biocide, also known as a polyquaternary biocide or polyquat biocide. On the order of 0.1% by volume of polymeric quaternary biocide is added. It has been found in the research related to this invention that a polymeric quaternary biocide destabilizes the charges surrounding emulsified oil droplets and serves as an effective emulsion breaker. As a result, the in-process industrial corn base oil is more effective in separating out of the water. Likewise, the polymeric nature of the polymeric quaternary biocide promotes settling of suspended matter, especially metals. It is also shown that using the polymeric quaternary biocide benefits the finished industrial corn base oil by inhibiting micro growth and gives the oil greater resistance to solubilizing water. Other quaternary compounds, cationic compounds, and other demulsification agents may be suitable in certain applications of the invention, but it is presently preferred to use a polymeric quaternary ammonium compound sold by Buckman Laboratories under the names Busan 77 and WSCP (water soluble cationic polymer), having the chemical name poly[oxyethylene(dimethyliminio)-ethylene(dimethyliminio)ethylene dichloride]. Further description of this and other polymeric quaternary compounds which may be useful in certain applications may be found in U.S. Pat. Nos. 3,771,989 and 4,506,081, which are hereby incorporated by reference.

The next part of step 14 is to agitate the mix again, preferably for 30-60 minutes. The solution is then allowed to set in the tank to allow separating, for 12-24 hours for example. At this point the solution can optionally be heated to 150° F. to speed up the separation process. The next step is to decant the bottom layer from the tank through a clear hose, which enables an operator to see the change from soapy water layer to oil (where yellow layer is soap water and the red is the oil). At this point, the oil is tested using test method ASTM D664 to verify that it is neutralized. If the test shows that the oil is neutralized, step 16 of the process is then performed. If not, it is preferred to repeat this step, recalculating the amount of KOH/water to put in based on the total acid number obtained from the ASTM D664 test, and, when finished, rechecking the total acid number by ASTM D664. Once the oil is neutralized, the process proceeds to the next step.

In step 16, the neutralized oil is transferred to a second 5000-gallon cone-bottom tank through an Air Tech L-40-G1 vacuum dehydrator to remove the rest of the water. The vacuum dehydrator is preferably set to a temperature in the range of 120-150° F., and 150° F. is most preferred because it has been shown to produce the best results. A Parker 10 micron bag filter is preferably used to remove larger particles, although other bag filters on the Air Tech L-40-G1 may be used, such as a 10-50 micron bag filter.

In step 18, a solution of citric acid 50% tech grade (0.5% by volume) is added to the oil in the second tank. (Example: 5 gallons of citric acid 50% tech grade added to 1000 gallons of corn oil). This is for degumming of the corn oil. While citric acid 50% tech grade is preferred, other grades of citric acid, and other acids, may be suitable in certain applications. The oil/acid mixture is agitated, preferably for 30-60 minutes. A kidney loop is set up with the Air Tech L-40-G1 vacuum dehydrator and the second tank, including a hose from the outlet at the bottom of the tank to an inlet of the vacuum dehydrator, and a hose from an outlet of the vacuum dehydrator to the top of the tank. With this setup, the in-process corn oil in the tank is recirculated through the vacuum dehydrator to remove water and filter out precipitates. This is done for a period of time, preferably 2-4 hours, with the vacuum dehydrator preferably set to a temperature in the range of 120-200° F., most preferably 180° F., and preferably with a Parker 10 micron filter to filter out precipitates. Other filters in the 10-50 micron range may be used instead.

In step 20, the oil is then transferred to clean totes being still at 180° F. One example tote is a 330-gallon square plastic tote provided with a 2' by 4' opening in the top. A mixer is mounted on the tote and turned on. One 80-lb bag of Oil-Dri Pure-Flo Supreme B81 bleaching earth is added to each tote and mixed with the oil for 10-20 minutes, then the mixture is allowed to sit for 2 hours. The Pure-Flo Supreme B81 removes the red color from the oil and leaves a yellow-colored oil. Common diatomaceous earth may be used in this step but Pure-Flo Supreme B81 provides superior results. A large open-top, cone-bottom bulk process tank with a 12" bottom opening may be used instead of totes.

As an alternative to step 20, or in addition to it, color removal can be effected using a chilling box trailer with a mixer added to stir the fluid at 10-200 rpm, preferably 60-80 rpm, and rapidly chill it to 32° F. The fluid may be transferred from the second tank to 330-gallon clean totes and moved in the totes to the chilling box trailer for mixing and cooling.

The top layer of oil in each tote is skimmed off through a portable filter cart using a 3-micron bag filter or filter cart and placed in a clean new tote or bulk process tank, leaving the Pure-Flo Supreme B81 in the prior tote or prior bulk process tank as the case may be. A 30-micron filter may be used instead of the 3-micron filter, as either a stainless steel filter or a bag filter. Filters up to 50-micron size may also be suitable in certain applications. The color of the oil is then checked using test method ASTM D1500. The preferred result is 2.0, and step 20 is repeated as necessary to obtain this result. Also, the oil is tested to make sure it is free of water, using test method ASTM D6304. If there is any water in the oil, the Air Tech L-40-G1 vacuum dehydrator should be used again at 180° F. to remove the water.

In step 22, the oil is then transferred to a final process tank where it is polished using a 3-5 micron filter element in a filter cart. At this point the oil is ready to be used to manufacture various products. A copolymer ester can be added to the finished industrial corn base oil at 0.1% to 2.5% to decrease the pour point of the oil for certain products. A methacrylate copolymer ester is preferred, one particular example being Lubrizol 6662.

One oil product according to the present invention is an industrial corn base oil which comprises neutralized corn oil in combination with a polymeric quaternary biocide. One preferred composition of such a corn base oil is as follows (all percentages by volume):

at least 96% neutralized corn oil, preferably neutralized according to the method described above;
0.05-1% polymeric quaternary biocide; and
0.1-2.5% methacrylate copolymer ester.

The amount of the polymeric quaternary biocide is preferably less than 0.25% and most preferably about 0.1%. One example of a preferred composition is 98.9% neutralized corn oil, 0.1% Busan 77, and 1% Lubrizol 6662. This composition has been found to have several advantageous properties, including a smoke point between 400° F. and 500° F., a flash point greater than 600° F., a viscosity index in the 210-218 range, and a pour point of −18.4° F. Another example composition, less preferred but still usable, has 97.4% neutralized corn oil, 0.1% Busan 77, and 2.5% Lubrizol 6662. In cases where no methacrylate copolymer ester is included, the neutralized corn oil is preferably more than 99% of the composition and is contemplated to contain a trace amount of polymeric quaternary biocide, or other quaternary compound, substantially less than 1%, and most preferably 0.1%.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

I claim:

1. A method of producing industrial corn base oil from a fermentation byproduct of a corn ethanol production process, said method comprising:

washing a fermentation byproduct of a corn ethanol production process to separate water-soluble products from raw corn oil, said washing step including adding water at about 100° F. to said fermentation byproduct in a first process tank in about a 1:3 ratio by volume, agitating the solution in said first tank for at least 30 minutes, allowing the solution to set for at least 12 hours and separate into layers, and removing the water layer;

neutralizing free fatty acid in the raw corn oil solution remaining in said first tank, said neutralizing step including adding a solution of potassium hydroxide to said raw corn oil solution in about a 1:4 ratio by volume, said potassium hydroxide solution containing about 0.05% potassium hydroxide by volume in water at about 100° F., and agitating the combined solution for at least 30 minutes;

adding about 0.1-2.5% by volume of a polymeric quaternary biocide to said combined solution, agitating the resulting solution for at least 30 minutes, allowing it to set for at least 12 hours and separate into layers, and removing the water layer;

passing the remaining corn oil solution through a vacuum dehydrator set at about 150° F. to a second process tank, filtering out larger particles; and degumming the corn oil solution in said second tank with about 0.5% by volume of 50% tech grade citric acid, employing a kidney loop to filter out precipitates.

* * * * *